United States Patent [19]

Goodman, Jr.

[11] Patent Number: 4,658,864

[45] Date of Patent: Apr. 21, 1987

[54] DETACHABLE CENTER BRACE APPARATUS FOR LOOM HARNESS

[75] Inventor: Robert M. Goodman, Jr., Marietta, Ga.

[73] Assignee: Ellison, Pioneer Division, Atlanta, Ga.

[21] Appl. No.: 726,499

[22] Filed: Apr. 24, 1985

[51] Int. Cl.[4] ..... D03C 9/06

[52] U.S. Cl. ..... 139/91

[58] Field of Search ..... 139/91, 92

[56] References Cited

U.S. PATENT DOCUMENTS

| | | | |
|---|---|---|---|
| 993,685 | 5/1911 | Holmes | 139/91 |
| 3,417,790 | 12/1968 | Pfarrwaller | 139/91 |
| 3,970,114 | 7/1976 | Baumann | 139/91 |
| 4,432,398 | 2/1984 | Root | 139/91 |

*Primary Examiner*—Henry S. Jaudon

*Attorney, Agent, or Firm*—George M. Hopkins

[57] ABSTRACT

A center brace apparatus for a loom frame or harness that extends between an upper and lower elongated frame members. One or more center brace members extend between the elongated frame members in abutting relationship therewith and are clamped to an associated frame member for a quick and simple installation and release. The center brace member is an elongated member that has T-shaped end or foot portions that abut surfaces on the elongated frame members. On each of the frame members is a clamping assembly that includes a hollow support bracket member with top, bottom and side walls. A sliding block member is disposed inside of the hollow bracket support member for sliding contact with side walls of the support bracket member. A screw member is received through one wall member and threadedly engages the slidable block member through a threaded opening in the slidable block member for moving the block member toward and away from the center brace member. A pair of U-shaped strip members or straps are pivotally mounted on the sliding block member for insertion over the T-shaped end portions of the center brace member. In one embodiment the center brace member is a relatively thin rod and in another embodiment the center brace member is a bifurcated member.

The bifurcated member is relatively wide and has channel portions that extend for substantially the entire length of the member. At one end of the center brace member are bifurcated elements that define a narrow slot extending along the center line of the member towards the center thereof with the slot opening increasing towards the center of the member.

12 Claims, 8 Drawing Figures

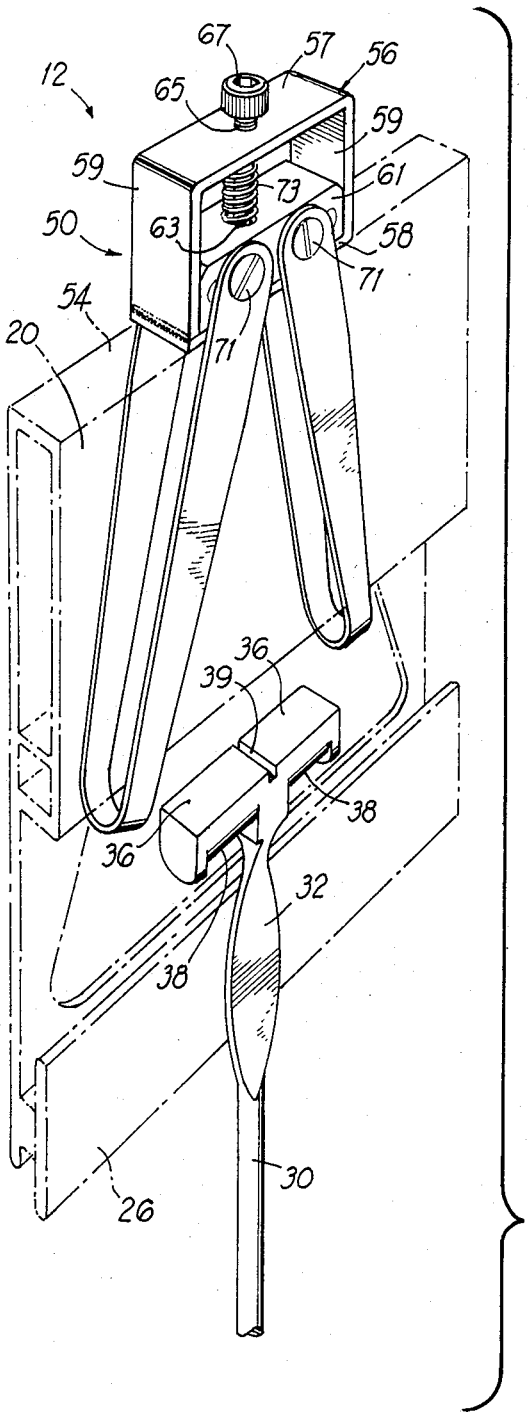
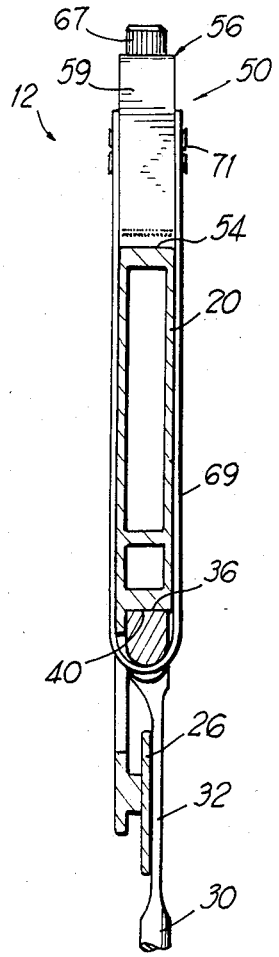
FIG 2
FIG 3

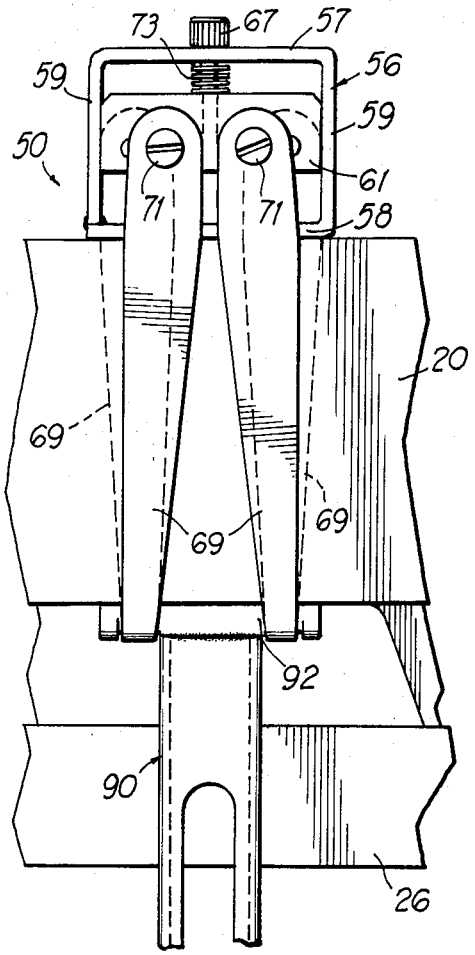
FIG 4
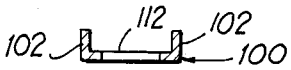
FIG 6
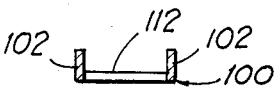
FIG 7
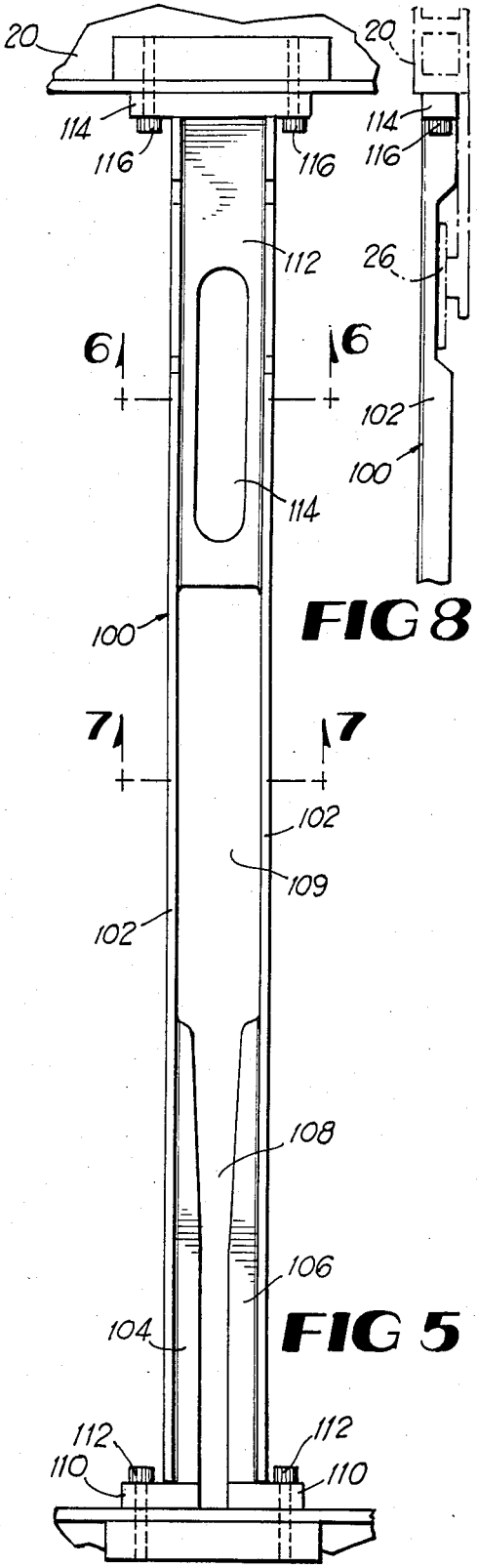
FIG 8
FIG 5

DETACHABLE CENTER BRACE APPARATUS FOR LOOM HARNESS

BACKGROUND OF THE INVENTION

1. Field of the Invention

This invention relates to weaving and in particular to an improved center brace apparatus for a loom harness.

2. Description of the Prior Art

It is well known that weaving consists of interlacing warp and filling yarns according to a predefined pattern. For example, for a plain weave, warp and filling yarns intersect so that ultimately the warp yarn goes over one and then under one filling yarn. The filling yarn does likewise with respect to the warp. The minimum number of harnesses required to produce this weave is two. Alternate warp yarns are threaded into harness one and the remaining alternate yarns are threaded into harness two.

Each individual yarn is threaded through a "heddle" or needle. The heddles are held in a frame called the harness. Each harness can be raised or lowered as desired, thus controlling the position of its heddles and warp yarns. Thus the harnesses will shift so that other sets of warp yarns are respectively raised and lowered and a shuttle motion causes the filling yarn to pass under the warp yarns which are raised by the harnesses and to pass over those warp yarns that are retained in their original lower positions by their remaining harnesses. Then the harnesses will shift so that other sets of warp yarns are respectively raised and lowered and the shuttle action again inserts filling yarn. In this way the fabric is woven.

A problem associated with the frames or harnesses has been the installation and removal of one or more center brace members which extend between the upper and lower members of the harness or frame members. It will be appreciated that the center brace member must provide proper support for the frames as they move up and down during the operation. At the same time it is essential that the center brace member or members, depending upon the length of the harness must be able to be installed or detached rapidly and simply and without interfering with the yarns, heddles or other operating apparatus. It is particularly important that the center brace member provide sufficient support to the frame members without weakening the frame members.

Still another problem associated with the center brace member is that this member be sufficiently strong but that it not be too wide. It has been found that too wide a brace member causes streaking of the cloth due to the close proximity of the center brace in relation to flat reeds or profile reed depending on the loom construction. However, if the center brace members are relatively narrow there may be a problem from the standpoint of strength and support for the frame members. Furthermore, it is desirable that when installing or detaching the center brace members that there be a minimum of interference with the yarns and heddles described above.

SUMMARY OF THE INVENTION

Briefly described, the present invention is for a center brace apparatus that includes one or more center brace members that extend between first and second elongated members making up the frame or harness of the loom. The center brace member has T-shaped end or foot portions that abut in surface contact with the first and second elongated frame members. The T-shaped end portions are clamped to the frame members securely but can be easily released from the frame members if desired.

On each of the elevated frame members in a hollow support bracket member which is secured to its respective frame member. The hollow support bracket member has a top wall, side walls, and a bottom wall. Either the top or the bottom wall contacts the elongated first or second elongated frame members depending upon whether it is the top or bottom frame member. Disposed inside of the hollow support bracket member is a slidable support block member that slides along the surface of the side walls of the hollow support bracket member. The slidable support block member is formed with a threaded hole which receives a screw member that is also received in either the top or bottom wall of the hollow support bracket member. By turning the screw member in first or second directions, the block member is caused to rise or lower toward or away from the center brace member.

Pivotally mounted on the support block member are a pair of U-shaped strip members or straps for clamping the T-shaped end portions of the center brace member securely to the elongated frame members. Thus by turning the screw member in a first direction, the sliding block member is moved in a first direction for tightening the strip members around the T-shaped end portions. By reversing the direction of the screw member the sliding block member is moved in a reverse direction for removing the strip members from the T-shaped end portions for detaching the center brace member. A spring biasing member is positioned between one of the wall members and the sliding block member to provide a biasing action against free movement of the block member.

A second aspect of the invention is the construction of the center brace member that is alternately a relatively thin rod member or a bifurcated member. The bifurcated member provides the desired strength and support to the elongated frame members during operation while avoiding the problems normally associated with relatively wide center brace members discussed above. The bifurcated member has side portions extending for substantially the length of the bifurcated member. One end of the bifurcated member has bifurcated elements that define a slot which extends from the end towards the center of the member. The length of the slot is less than half the length of the bifurcated member and the width of the slot increases slightly towards the center of the bifurcated center brace member. The central portion of the bifurcated brace member is open to the extent of the width of the member except for the side portions extending along thereof.

The other end of the bifurcated members and the bifurcated center brace member have back plates with a cross-section in the shape of a channel, said channel having a depth sufficient to permit the insertion of heddles between the side portions. The back plate of the end opposite the bifurcation extends for less than half the length of the member and has an opening formed therein. Each of the bifurcated elements has a plate member connected thereto at right angles. Each plate member has a hole formed therein for securing the bifurcated element to the frame by a screw member or the like. At the opposite end of the bifurcated center brace member there is a plate member extending at right angles thereto. The plate member has a pair of holes, one on each side of the center brace member for securing the end of the center brace member to the frame by screw members or the like.

BRIEF DESCRIPTION OF THE FIGURES

FIG. 2 is a sectional view taken along lines 2—2 of FIG. 1;

FIG. 3 is a perspective view of the center brace apparatus;

FIG. 4 is a partial front elevation view of a second embodiment of the center brace apparatus illustrating a bifurcated brace member;

FIG. 5 is an elevation view of the center brace apparatus illustrating a different embodiment of the invention;

FIG. 6 is a sectional view taken along lines 6—6 of FIG. 5;

FIG. 7 is a sectional view taken along lines 7—7 of FIG. 5; and

FIG. 8 is a partial side elevation view of the embodiment shown in FIG. 5.

DESCRIPTION OF THE PREFERRED EMBODIMENTS

Figure 1:
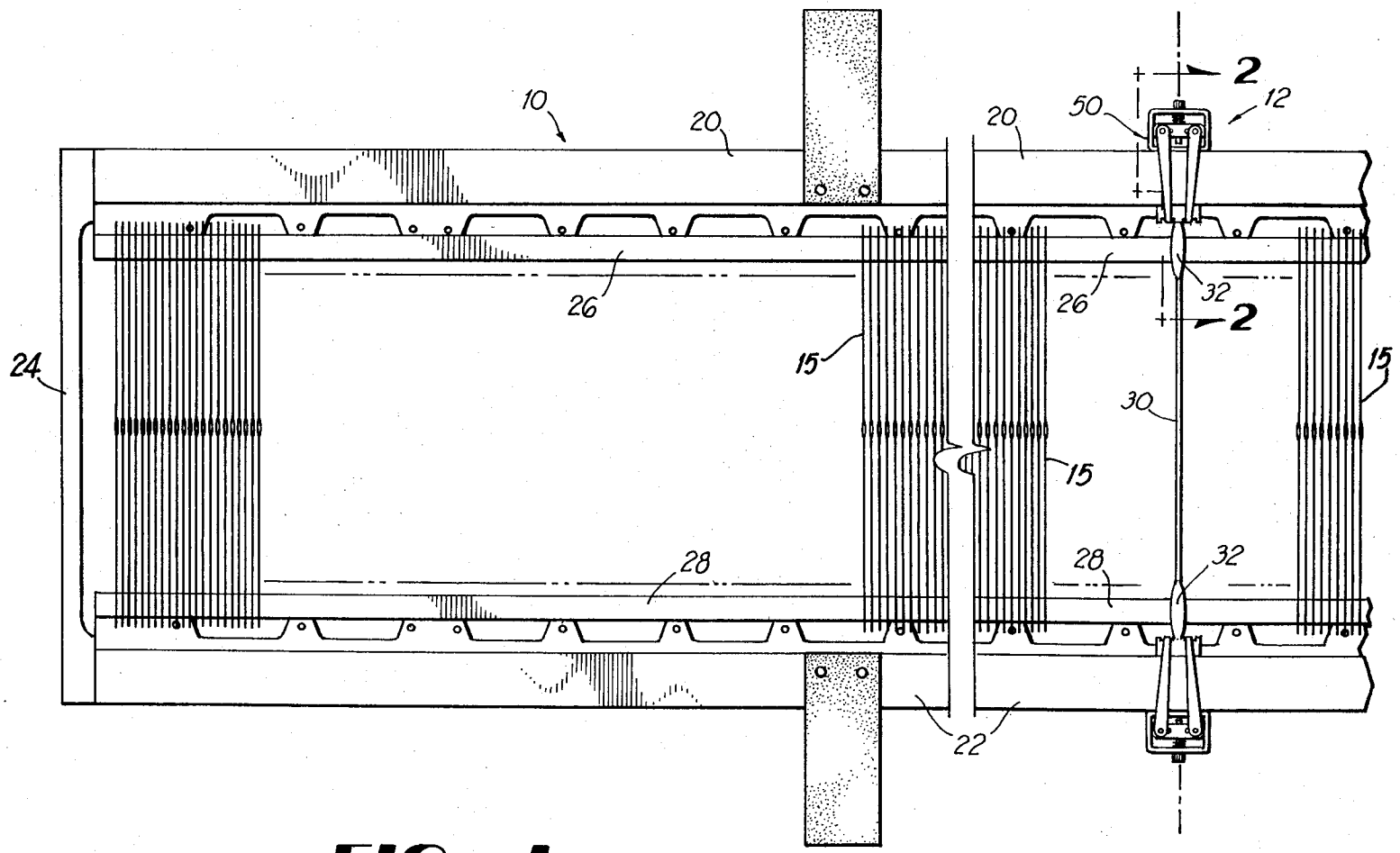
FIG. 1 is a front elevation view of a loom harness incorporating center brace apparatus according to the present invention.

Referring now to FIG. 1, there is shown the frame or harness 10 of a loom incorporating a center brace apparatus 12 according to the invention. A plurality of heddles or needles 15 supported on the frame are used for threading warp yarns (not shown). The frame can be raised or lowered, as desired, thus controlling the position of heddles and warp yarns. The frame includes an upper elongated frame member 20, a lower elongated frame member 22, end member 24, upper heddle rod member 26, and lower heddle rod member 28. Center brace apparatus 12 serves to support the upper and lower elongated frame members 20 and 22.

In accordance with the present invention, center brace apparatus 12 is easily detached from the frame members without interfering with or otherwise removing any of the heddles. Center brace apparatus 12 includes an elongated rod member 30 that has flattened portions 32 in close proximity to the ends thereof to increase strength of the rod member.

As illustrated in FIGS. 2 and 3, at the ends of the rod member are T-shaped foot portions 36 that contact wall surfaces 40 and 42 of elongated frame members 20 and 22, respectively. It will be noted that foot portions 36 are formed with recessed portions 38 and groove 39. The T-shaped foot portions 36 of the rod member 30 are clamped to the frame by clamping assemblies 50 in a manner that will become more apparent hereinafter. Since the two clamping assemblies 50 for securely clamping the T-shaped foot portions to the elongated frame members are the same, only one of them will be described in detail, it being understood that like reference numbers refer to like parts.

Clamping assembly 50 is positioned on wall surface 54 of elongated frame member 20 in any suitable manner as by pins or the like (not shown). Assembly 50 includes a hollow support bracket member 56 which has a top wall 57, a bottom wall 58 and side walls 59. Disposed inside of the support bracket member 56 in sliding contact with the side walls 59 is a block support member 61. Block support member 61 has a threaded hole 63 formed therein for receiving a threaded screw member 65 that is turned by the use of a threaded knob member 67.

Pivotally connected to the block support member 56 are a pair of U-shaped strip members or straps 69 that are mounted on screw members 71. The U-shaped strip members 69 encircle the elongated frame member extending between the wall surfaces 42 and 54 and also the T-shaped foot portion 36 of the rod member. It will be noted that the recessed portions 38 of the T-shaped foot portion 36 engage strip members 69 to provide a good surface contact therebetween.

By rotation of screw member 65 in a clockwise direction the block support member 61 is moved vertically upwards pulling strip members 69 securely against T-shaped foot portion 36. Rotation of the screw member in a counterclockwise direction releases the strip members from the foot portion. A spring biasing member 73 serves to bias the block support member 61 and hence the strip members in a direction that facilitates release of the T-shaped foot portion that is engaged by the strip members. Thus when tightening the strap members around the T-shaped foot portion turning the screw member causes the spring biasing member 73 to compress.

It will now be appreciated that by virtue of the unique construction of the center brace apparatus the center brace member may be installed and detached from the frame or harness rapidly and simply. Moreover, the installation and removal of the center brace member does not interfere with the heddles.

FIG. 4 illustrates a second embodiment of the center brace member which has a bifurcated construction. In FIG. 4 the bifurcated center brace member 90 is releasably secured by clamping assembly 50 that is shown in FIGS. 1 through 3. A T-shaped foot portion 92 on each end of the bifurcated member 90 is clamped to the frame in a manner as previously described.

It will now be appreciated that the center brace apparatus of the invention can be installed rapidly and easily. Yet the construction of the brace apparatus is sufficiently strong to support the frame or harness as needed. Furthermore, the installation of the center brace does not require penetration through the upper or lower frame members often referred to as shafts or rails of the frame or harness. Moreover, the center brace member is replaceable while on the loom with heddles in place. It will be further appreciated that the center brace member can be installed or released from above or below the frame. Furthermore, the U-shaped strip members or straps provide a strong clamping action and yet permit a limited sliding adjustment for tolerances.

Referring to FIGS. 5 through 8, there is shown another embodiment of the invention in which a bifurcated center brace member 100 supports the upper and lower elongated frame members. The bifurcated center brace member 100 includes side portions 102 extending substantially along the length thereof. At one end of the center brace member are bifurcated elements 104 and 106 having corresponding back plates 104' and 106' which define a narrow slot 108 that widens slightly before communicating with an opened area 109 disposed at the central portion of the brace member. The other end of the brace member has a solid cover back plate 112 with an opening 114 formed therein. In cross-section the solid back plate 112 and back plates 104' and 106' have a channel shape, the depth of the channel being sufficient to permit the insertion of heddles between the side portions.

It will be appreciated that the bifurcated elements 104 and 106 provide support at the lower portion of the center brace member. By virtue of the slot opening 108 there is no interference with the heddles when installing or detaching the center brace member.

Plate members 110 are connected to the bifurcated elements 104 and 106 in any suitable manner, such as, by welding. The plate members 110 have holes therein to receive screw members 112 for securing the end of the center brace to the frame. In similar fashion the opposite end of the center brace member has a plate member 114 which is secured to the center brace member in any suitable manner 114. The plate member has holes for receiving screw members 116 for securing the end of the center brace member to the frame. By this structure the center brace may be installed or removed simply and rapidly.

It has been found that the bifurcated center brace member described above significantly reduces streaking or "dents" that are caused by the width of a conventional center brace member. Good stability is provided by the bifurcated center brace member. It will be further noted that the slot opening and open area in the center of the bifurcated center brace member enables getting the brace member over warp yarns which might otherwise interfere with the brace member during installation or removal thereof.

It will be appreciated that changes can be made to the foregoing apparatus without departing from the spirit of the invention. For example, instead of having a single block support member suporting the U-shaped strip members there may be two block members with a single strip member pivotally hinged to each one. Still other changes will become apparent to those that are skilled in the art without departing from the spirit of the invention or the scope of the following claims:

What is claimed is:

1. Center brace apparatus for a loom harness or the like comprising a frame including first and second elongated members having a plurality of surfaces extending in parallel spaced relationship;

at least one brace member extending between said first and second elongated members, said brace membr having a T-shaped portion at each end thereof with the the top of the T-shaped portions abutting first parallel surfaces on said first and second elongated members;

support bracket means positioned on second parallel surfaces of said first and second elongated members, said support bracket means having side walls;

slidable block means disposed within said support bracket means for sliding movement along said side walls; clamping means pivotally mounted on said slidable block means for engaging said T-shaped portions; and control means for controlling the position of said slidable block means relative to said elongated members whereby said clamping means may be releasably secured from engaging said T-shaped portions of said brace member.

2. Apparatus according to claim 1 wherein said clamping means includes a pair of U-shaped strips pivotally mounted on said slidable block means.

3. Apparatus according to claim 2 wherein said T-shaped portions are recessed in the vicinity of engagement by said U-shaped strips.

4. Apparatus according to claim 1 wherein said control means included a rotatable screw member threadedly engaging said slidable block means.

5. Apparatus according to claim 4 including a spring biasing member disposed between said support bracket means and said block means.

6. Apparatus according to claim 1 wherein said elongated frame members extending between said first and second parallel surfaces are encircled by said U-shaped strips.

7. Apparatus according to claim 1 wherein said brace member is a solid rod member.

8. Apparatus according to claim 1 wherein said brace member is a bifurcated member.

9. An improved center brace device for a loom harness or the like comprising an elongated member having side portions extending for substantially along the entire length thereof;

said elongated member having bifurcated elements at one end thereof to define a slot that extends along the centerline of the member for a distance less than one-half the length of the member;

said slot communicating with an opening at the central portion of said member, said opening and slot when combined together extending for a distance exceeding more than half the length of the elongated member; and the bifurcated elements and the end opposite the bifurcation having back plates which in cross-section define a channel with a depth sufficient to permit insertion of heddles between the side portions.

10. Apparatus according to claim 9 wherein the end opposite the bifurcated elements has a support member connected and extending at right angles thereto, said support member having a hole formed therein on each side of said elongated member for securing said member.

11. A center brace device according to claim 9 wherein the back plate of the end opposite the bifurcation extends less than half the length of the member and has an opening formed therein.

12. Apparatus according to claim 9 wherein said bifurcated end has a support member connected to each bifurcated element extending at right angles thereto, each of said support members having a hole formed therein for securing said member.

* * * * *